US007555878B2

(12) United States Patent
Brioschi

(10) Patent No.: US 7,555,878 B2
(45) Date of Patent: Jul. 7, 2009

(54) DEVICE FOR SEALING BAGS CONTAINING POWDER OR GRANULAR MATERIALS

(75) Inventor: Sergio Brioschi, Milan (IT)

(73) Assignee: Ventomatic S.p.A., Valbrembo (Bergamo) (IT)

( * ) Notice: Subject to any disclaimer, the term of this patent is extended or adjusted under 35 U.S.C. 154(b) by 0 days.

(21) Appl. No.: 11/884,126

(22) PCT Filed: Feb. 18, 2005

(86) PCT No.: PCT/IT2005/000089

§ 371 (c)(1),
(2), (4) Date: Aug. 10, 2007

(87) PCT Pub. No.: WO2006/087741

PCT Pub. Date: Aug. 24, 2006

(65) Prior Publication Data

US 2008/0098694 A1 May 1, 2008

(51) Int. Cl.
*B65B 51/16* (2006.01)
*B65B 7/00* (2006.01)

(52) U.S. Cl. ..... 53/374.5; 53/374.4; 53/375.4

(58) Field of Classification Search ..... 53/373.2–378.3
See application file for complete search history.

(56) References Cited

U.S. PATENT DOCUMENTS 2,845,760 A * 8/1958 Hopkins et al. ..... 53/67
3,064,403 A * 11/1962 Tokos et al. ..... 53/477
3,285,295 A * 11/1966 Titchenal et al. ..... 141/10
3,471,990 A * 10/1969 Bonuchi et al. ..... 53/434
3,505,136 A * 4/1970 Attwood ..... 156/73.1
3,792,563 A * 2/1974 Mercer et al. ..... 53/461
4,003,188 A * 1/1977 Lau ..... 53/525
4,145,236 A * 3/1979 Neumayer et al. ..... 156/73.1
4,537,016 A * 8/1985 Shanklin et al. ..... 53/493
4,566,505 A * 1/1986 Ruf et al. ..... 141/83
4,688,370 A * 8/1987 Dighton et al. ..... 53/469
4,715,166 A * 12/1987 Kameda ..... 53/550
4,723,390 A * 2/1988 Duke ..... 53/373.4
4,756,142 A * 7/1988 Tetenborg et al. ..... 53/481
RE35,243 E * 5/1996 Tolson ..... 198/343.1
5,549,734 A * 8/1996 Standard ..... 95/279
5,620,542 A 4/1997 Avila et al.
6,574,939 B1 * 6/2003 Heijnen et al. ..... 53/133.4
6,748,723 B2 * 6/2004 Wadium et al. ..... 53/469
2004/0050671 A1 * 3/2004 Hovsto et al. ..... 198/806

FOREIGN PATENT DOCUMENTS

DE 27 04 139 A1 8/1978
DE 196 42 438 A1 4/1998
EP 0 768 242 A1 4/1997

* cited by examiner

*Primary Examiner*—Paul R Durand
(74) *Attorney, Agent, or Firm*—Young & Thompson

(57) ABSTRACT

Device for closing bags for containing powder or granular materials, suitable for installation within a belt, roller or similar line for conveying bags, including at least one sealing head (52) and a conveyor member (27) for feeding the bags (60) to the sealing head (52), characterised in that the sealing head (52) presents drive elements (51, 53, 54, 55) causing it to advance, during the sealing process, at the same speed as the conveyor member to enable it to seal a bag (60) while the conveyor member is moving.

16 Claims, 3 Drawing Sheets

DEVICE FOR SEALING BAGS CONTAINING POWDER OR GRANULAR MATERIALS

TECHNICAL FIELD

The present invention relates to a device for closing bags for containing powder or granular materials in accordance with the introduction to the main claim.

In particular, it relates to a device for sealing normally paper bags containing powder or granular materials used in various sectors and of very wide application in building work.

BACKGROUND ART

In one corner these bags present, for access to the bag interior, a passage which when the bag has been filled enables the contained material to be tightly closed off but not sealed.

In particular, bags are known having a projecting valve formed as a prolongation of the said passage and closable to achieve complete sealing of the bag.

The valve is made of paper coated on its inside with plastic material usable for sealing the bag.

The known method uses a suitable machine to fill the bags. One embodiment of this machine presents a central rotary portion from which feed ports radially branch, other machines comprise a series of static ports. The valves of the bags to be filled are drawn over the feed ports via the passage created by the valve. In this manner each feed port pours its contents into the bag.

On termination of the filling operation, the valve is sealed by a suitable device. This sealing can be achieved by different known devices operating by ultrasound, knurling, thermal heating, etc.

Sealing can be carried out either when the bag is still on the filling port or downstream of the filling machine, during the bag processing and conveying cycle.

Generally, if the sealing operation is carried out on the bagging machine, it considerably reduces the machine production capacity. This is a considerable drawback and strongly influences the processing time and the productivity of the production cycle.

An object of the present invention is therefore to provide a device for closing bags for containing powder or granular materials while on the bag conveying line which represents an improvement on the known art in the sense that it allows sealing without slowing down the line working rate, hence increasing productive capacity to the maximum levels attainable with available bagging techniques.

DISCLOSURE OF THE INVENTION

This and further objects are attained by a device for closing bags for containing powder or granular materials in accordance with the technical teachings of the accompanying claims.

The solution proposed herein does not block the bag filling and conveying flow, so increasing the number of bags processed.

Such a machine enables a quick sealing operation to be added to already existing lines, so avoiding the investment involved in purchasing a completely new filling machine with incorporated sealing.

BRIEF DESCRIPTION OF THE DRAWINGS

Further characteristics and advantages of the invention will become apparent from the ensuing description of a preferred but non-exclusive embodiment of the device for closing bags or containing powder or granular materials, illustrated by way of non-limiting example in the accompanying drawings, in which.

BEST MODE FOR CARRYING OUT THE INVENTION

Figure 1:
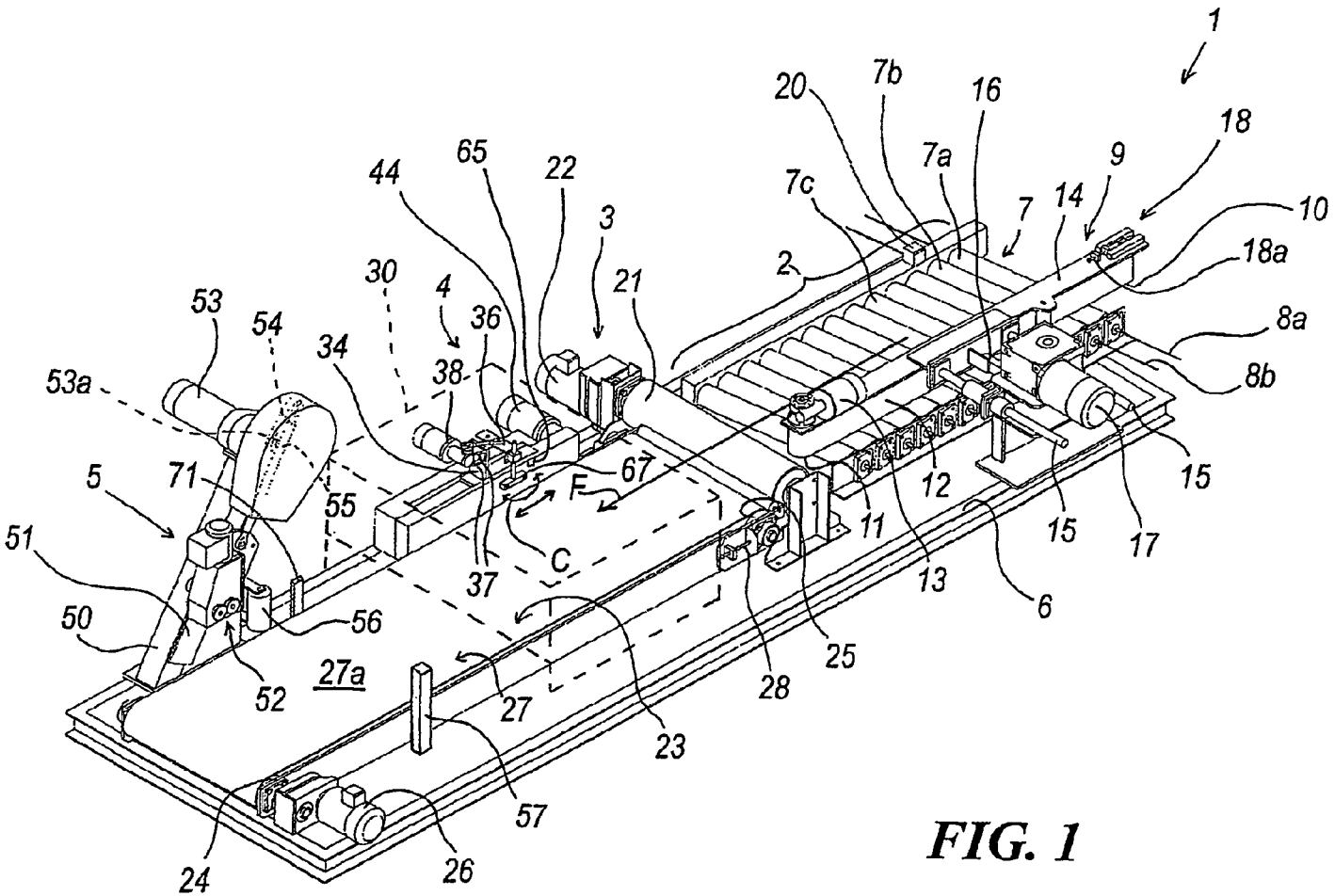
FIG. 1 is a perspective view of a device according to the invention in its inactive state.

With reference to said figures, these show a device for closing bags for containing powder or granular material, indicated overall by 1.

It comprises a bag aligning unit 2, a pacing unit 3, a valve cleaning unit 4 and a sealing unit 5. These units are fixed in conventional manner to a frame resting on the ground, and are aligned in series. The alignment unit 2 comprises a roller conveyor 7. This roller conveyor 7 consists of a plurality of rollers 7*a*, 7*b* etc. presenting parallel axes 8*a*, 8*b* inclined by about 10° to a common advancement direction, indicated by the arrow F in FIG. 1. All the rollers are rotated in synchronism by a single electric motor (not shown). Advantageously the rollers 7*a*, 7*b*, etc. present a steel outer surface.

The roller conveyor 7 is bounded on one side (in the figures the left side, with respect to the bag advancement direction) along its entire length by a retaining wall 9 disposed in a plane perpendicular to that of the rollers 7 and parallel to the advancement direction F. The retaining wall 9 consists of a band 12 slidable in said plane taut between a first roller 11 and a second roller 10. The roller 11 is connected to a motor 13 which drives it, to hence also drive the band 12. The roller 10 presents known means 18 for adjusting its position, in order to adjust the tension of the band 12. In practice the roller 10 can be moved away from or towards the roller 11 to adjust the tension of the band 12 by the adjustment screw 18*a*. The rollers 10, 11 are secured to and supported by a movable structure 14 associated with guides 15 enabling this latter to slide horizontally above the roller conveyor 7. The position of the movable structure 14 (and hence of the retaining wall 9) is adjusted in known manner by a motor 17 cooperating with a rack 16 associated with the structure 14.

Both the drive motor for the roller conveyor 7 and the drive motor 13 for the band present speed adjustment means.

The alignment unit also comprises a photoelectric cell 20 which monitors the filling density of the unit to verify that the bags have not completely filled it.

Downstream of the alignment unit 2 a pacing unit 3 is present comprising a rubber clad roller 21 rotated by a relative gearmotor 22 coupled to a frequency variator to regulate the speed of the roller 21. This roller is substantially aligned with the plane defined by the roller conveyor 7.

The use of this roller 21 will be clarified hereinafter.

Downstream of the pacing unit 3 and aligned with the roller 21 there is a conveyor belt 23 of conventional type. It comprises a pair of rollers 24, 25 between which a horizontally disposed belt 27 is stretched. The roller 25 is movable to conventionally adjust the tension of the belt 27 by means of the screw 28, the roller 24 being rotated by a gearmotor 26.

Flanking the conveyor belt on the opposite side to the retaining wall 9 (and hence on the right side in the present example) there is a valve cleaning unit 4 completely surrounded by a housing 30 shown by dashed lines. The housing surrounds the entire valve cleaning unit 4 and part of the conveyor belt. Inside the housing 30 a vacuum region is created by conventional suction means.

Figure 4:
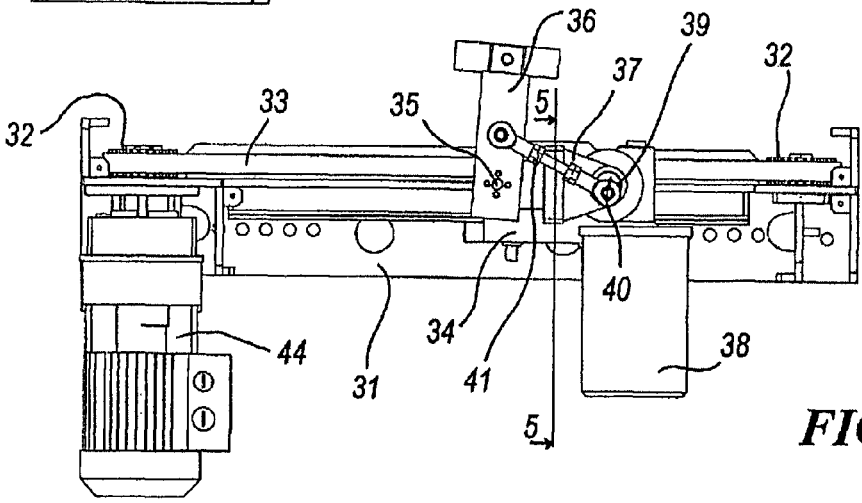
FIG. 4 is a plan view of a valve cleaning unit of the device of FIG. 1.
Figure 5:
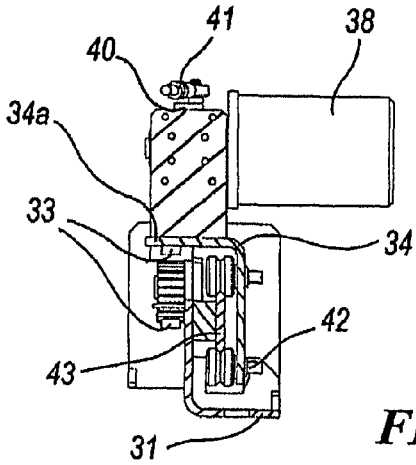
FIG. 5 is a section taken on the line 5-5 of FIG. 4.

The valve cleaning unit 4 is visible in FIG. 4 and comprises a base 31 resting on the frame 6 to which a pair of toothed pulleys 32 are secured, one of which is idle whereas the other is coupled to a gearmotor 44. About the two toothed pulleys there passes a toothed belt 33 having a part rigidly fixed to a slidable structure 34. Profiled wheels 42 projecting from this latter engage a guide 43 rigid with the base 31. The slidable structure 34 also presents a swinging arm 36, pivoted at 35 on a horizontal portion 34*a* thereof. The structure 34 also supports a gearmotor 38 by a pair of brackets 37. An output shaft 39 from the gearmotor is connected to a cam 40 hinged to a connecting rod 41 which is also connected to the swinging arm 36. The swinging arm 36 supports a series of height-adjustable nozzles 67 fed with compressed air in known manner.

Upstream of the valve cleaning unit 4 the is a mechanical sensor 65 which sets the unit 4 in operation when a bag arrives.

A sealing unit 5 is provided downstream of the valve cleaning unit 4. The sealing unit 5 comprises, secured to the frame 6, a support element 50 on which there is a guide 51 inclined at 60° (angle $\alpha$) to the resting surface 27*a* of the conveyor belt 27, and on which there slides a sealing equipment 52 by means of toothed wheels.

The support 50 supports a gearmotor 53 presenting an output shaft 53*a* connected to a crank 54 hinged to a connecting rod 55. The connecting rod 55 is also hinged to the sealing head 52, specifically to a plate 100 presenting four profiled wheels 101 cooperating with the guide 51 to guide the plate 100. The plate 100 is rigidly fixed to the sealing head 52 by stiffening ribs 103.

The sealing equipment 52 is of the type comprising two meshing toothed wheels 59, one being a drive wheel driven by a gearmotor 64, the other being the driven wheel. The two toothed wheels 59 bring into mutual contact the upper side and lower side of the valve, which are clad with a plastic layer of low melting point (for example polyethylene, etc.) applied on the inside of the valve 60*a*. In this manner the valve 60*a* becomes sealed.

Upstream of the sealing procedure there is an idle roller 56 movable in a horizontal plane, and mounted on means (not shown but conventional) enabling it to assume a first position withdrawn from the conveyor belt 27 and a second position in which the roller 56 is superposed on the belt 27. The movement of the roller 56 is controlled on the basis of information received by a mechanical sensor 71.

Figure 2:
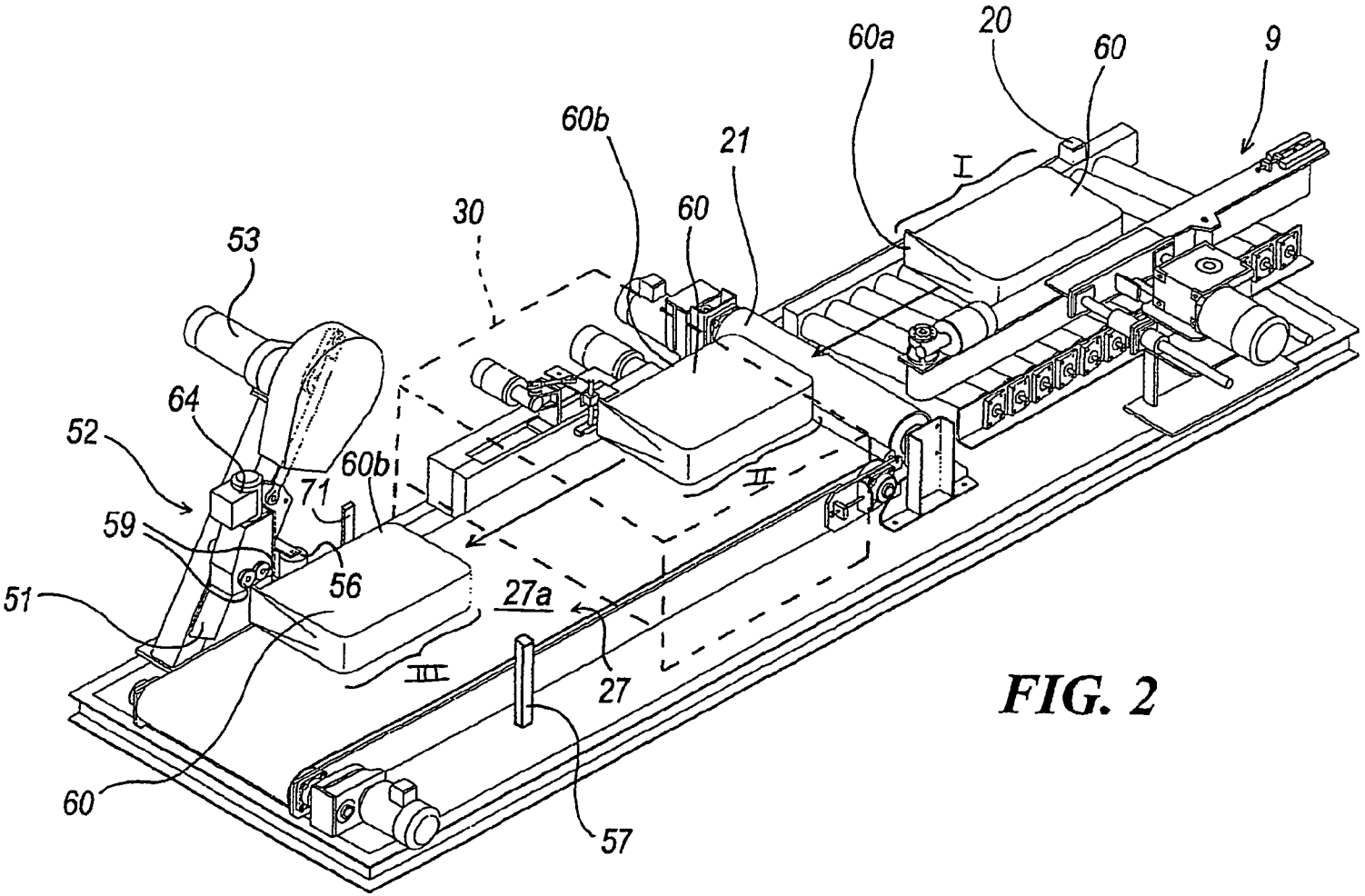
FIG. 2 is a perspective view of the device of FIG. 1 while processing bags.
Figure 3:
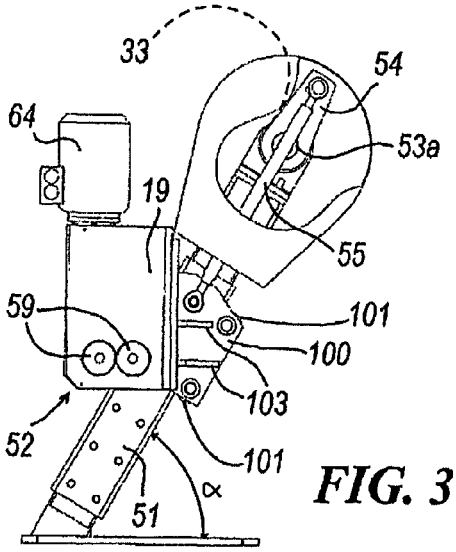
FIG. 3 is a side view of a sealing unit of the device of FIG. 1.

FIG. 2 shows the device of FIG. 1 while processing a bag 60 previously filled in known manner with powder material.

The bag 60 is shown in its various processing stages, i.e. the feed stage I, the valve cleaning stage II and the sealing stage III.

The bag 60, which presents on the right side a projecting valve 60*a* through which it was previously filled by a filling line, not shown, is deposited on the roller conveyor 7, such that the valve 60*a* lies opposite the retaining wall 9.

The particular inclination of the rollers 7*a*, 7*b* urges the bag 60 against the band 12 of the retaining wall 9. Essentially, the particular roller inclination means that all the bags reaching the roller conveyor become aligned against the reference surface given by the retaining wall 9.

The speed of the band 12 and the peripheral speed of the rollers 7*a*, 7*b* must be similar but not necessarily equal. If the speed of the band 12 is slightly higher, the bag 60 tends to rotate clockwise (with reference to FIG. 2) whereas if lower it rotates anticlockwise.

An electromechanical system enables the position of the retaining wall 9 to be changed with precision, to hence adapt the reference surface to different bag widths, so that the valve lies external to the roller conveyor 7. The position of the retaining wall 9 is set by a known control system.

The bag 60 then comes into contact with the pacing roller 21. The speed of the roller 21 determines the rate at which the bags 60 are fed to the subsequent processing stages. Its surface is made of rubber or a material of high friction coefficient. The bags coming into contact with the pacing roller 21 are slowed down and their speed adjusted to that set for the roller. Given that a bag simultaneously engaged by the pacing roller 21 and by the roller conveyor it will slip on this latter as the surface of the rollers 7*a*, 7*b*, etc. is made of material of low friction coefficient (in this example steel).

The bag 60, deposited on the conveyor belt 27, enters the housing 30 which is under vacuum, and as it passes in front of the mechanical sensor 65 compressed air is fed through the nozzles 67.

The gearmotors 44 and 38 are also activated. The speed of the gearmotor 44 is such as to enable the slidable structure 34 to move to follow the bag advancement. The speed of the conveyor belt 27 and of the slidable structure 34 are substantially identical.

The linkage operated by the gearmotor 38 moves the nozzles 67 along a circular arc trajectory C, to enable the compressed air to effectively clean off any powder residue on the valve 60*a*. The nozzles 67 remain in correspondence with the valve 60*a* for a time sufficient to clean the valve of any dust residue.

Given that the operation takes place within a vacuum environment, any residue is sucked out in conventional manner.

On termination of the valve cleaning stage the gearmotor 44 reverses its motion and returns the slidable structure 34 to its initial position, ready to process another arriving bag.

The bag 60 which has just been cleaned intercepts the mechanical sensor 71, the roller 56 retracts to allow the valve 60*a* to pass, then again contacts the bag to limit the extent of its projection.

The roller 56 prevents the bag 60 from touching the outline of the sealing head 52 during the sealing operation.

When the valve 60*a* comes into proximity with the toothed wheels 59, both the gearmotor 64 and the gearmotor 53 are activated by the aforesaid sensor 71 or by another sensor, not shown.

The end of the valve 60*a* engages between the toothed wheels 59 and the sealing operation begins. The sealing head 52 descends downwards along the guide 51 and simultaneously advances to follow the bag conveyed by the belt 27.

The peripheral speed of the toothed wheels is equal to the vertical component of the movement of the sealing head 52, the horizontal component of the movement of the head 52 being equal to the translational speed of the belt 27 and hence of the valve 60*a*.

The sealing head must have a constant speed during the sealing operation. A connecting rod-crank system is known not to enable uniform movement to be obtained during the sealing procedure if the crank rotational speed is constant. The motor 53 is of brushless type associated with an electronic control device which, by imposing a non-uniform rotational speed, enables disuniformities in the movement of the head 52, induced by the connecting rod-crank linkage, to be compensated.

On termination of bag sealing, the head 52 again rises along the guide until it reaches the initial position, ready to seal the next bag. The valve 60*a*, with the plastic layer present in its interior, passes for its entire length between the toothed wheels 59. The toothed wheels 59 are arranged such that at the end of this passage the two plastic surfaces are bonded together, the bag being hence sealed.

Typically the bags arriving from a bagging line are conveyed at a speed between 1 and 1.25 m/sec.

The roller conveyor 7 has a lower speed, being a compromise between the bag entry speed and the speed downstream of the pacing roller 21. A good speed is about 0.8 m/sec, at this speed there being no contract between the bags (which can hence slide better one to another) even for high capacity lines.

The conveyor belt 27 on which the bags are conveyed moves at a speed typically set at 0.5 m/sec which corresponds to a capacity of 4000 bags/hour of length 45 cm (25 kg) and 3000 bags/hour of length 60 cm (50 kg). The speed of the cleaning nozzles is hence also 0.5 m/sec.

As a result, if the machine is fed at a capacity of 4000 bags/hour with 25 kg bags or 3000 bags/hour with 50 kg bags, the bags downstream of the pacing roller 21 would all be close together.

Higher speeds for the conveyor belt 27 would allow higher production rates.

If the bag conveying speed is 0.5 m/sec as stated, trigonometric calculations show that the descent speed is about 0.86 m/sec and the head speed along the guide is 1 m/sec.

A suction point can be provided at the sealing unit to put the surrounding environment under vacuum. The effect of the vacuum is that the sides of the valve to be sealed close against each other to facilitate the sealing process.

In alternative embodiments the sealing head can utilize a different mechanism, for example ultrasound, sewing, heating with air or infrared heating.

The drive head can also comprise alternative drive means to the connecting rod-crank linkage, such as a toothed belt.

As an alternative to the described cleaning unit 4, a static series of nozzles connected to the compressed air and fed sequentially could effectively replace the movable nozzles.

As an alternative to the roller conveyor 7, a belt conveyor with its belt (inclined) of low friction coefficient could be used.

The invention claimed is:

1. A device for closing valved bags, having a projecting valve, for containing powder or granular materials, suitable for installation within a belt, roller or similar line for conveying bags, comprising:

at least one sealing head; and a conveyor means for feeding the bags to the sealing head, wherein the sealing head presents drive means causing the sealing head to advance, during the sealing process, at the same speed and direction as the conveyor means and to simultaneously move the sealing head in a direction perpendicular to the direction of the conveyor means to enable the sealing head to seal the projecting valve of the bag while the conveyor means is moving, wherein the drive means comprise a guide on which the sealing head is slidable, and wherein the guide is inclined to a resting surface of the conveyor belt.

2. The device as claimed in claim 1, wherein the conveyor means is a conveyor belt or a roller conveyor.

3. The device as claimed in claim 1, wherein the sealing head is of toothed wheel type.

4. The device as claimed in claim 1, wherein the inclination ($\alpha$) of the guide to the surface of the conveyor means is 60°.

5. The device as claimed in claim 1, wherein the horizontal component of the speed of the sealing head is equal to the speed of the conveyor means.

6. The device as claimed in claim 1, wherein a retaining roller is provided upstream of the sealing head.

7. The device as claimed in claim 1, wherein a pacing roller is provided upstream of the conveyor means.

8. A device as claimed in claim 1, further comprising upstream of the sealing head a conveyor belt inclined to a retaining wall, said belt urging the bags towards the retaining wall.

9. The device as claimed in claim 1, wherein upstream of the sealing head a roller conveyor is present comprising a plurality of rollers presenting their axes of rotation parallel to each other and inclined to a retaining wall, said rollers, by their movement, urging the bags towards the retaining wall.

10. The device as claimed in claim 9, wherein the retaining wall presents for the bags a movable bearing surface comprising a sliding band passing taut between two rollers, one of which is motorized.

11. The device as claimed in claim 9, wherein said retaining wall presents means for adjusting its position relative to the roller conveyor.

12. A device for closing valved bags, having a projecting valve, for containing powder or granular materials, suitable for installation within a belt, roller or similar line for conveying bags, comprising at least one sealing head and a conveyor means for feeding the bags to the sealing head, wherein the sealing head presents drive means causing the sealing head to advance during the sealing process, at the same speed as the conveyor means to enable the sealing head to seal the projecting valve of the bag while the conveyor means is moving, wherein the drive means comprise a guide on which the sealing head is slideable, and wherein the sealing head is connected to a connecting rod-crank linkage operated by a brushless motor associated with an electronic control device.

13. A device for closing valved bags, having a projecting valve, for containing powder or granular materials, suitable for installation within a belt, roller or similar line for conveying bags, comprising at least one sealing head and a conveyor means for feeding the bags to the sealing head, characterised in that the sealing head presents drive means causing it to advance, during the sealing process, at the same speed as the conveyor means to enable it to seal the projecting valve of the bag while the conveyor means is moving, wherein a valve cleaning unit is provided upstream of the sealing head to clean the valve of dust traces.

14. The device as claimed in claim 13, wherein the valve cleaning unit comprises at least one nozzle presenting its own drive means enabling it to advance at the same speed as the conveyor means, so that it is able to clean the valve while the conveyor means is moving.

15. The device as claimed in claim 13, wherein the valve cleaning unit comprises a series of nozzles connected to compressed air and fed sequentially.

16. The device as claimed in claim 13, wherein the valve cleaning unit comprises a structure which directly supports at least one nozzle, said structure presenting means conferring a swinging movement on said structure.

* * * * *